US012768226B2

(12) United States Patent
Bilen et al.

(10) Patent No.: US 12,768,226 B2
(45) Date of Patent: Oct. 20, 2026

(54) EARTH-BORING TOOLS, NOZZLES, AND ASSOCIATED STRUCTURES, APPARATUS, AND METHODS

(71) Applicant: Baker Hughes Oilfield Operations LLC, Houston, TX (US)

(72) Inventors: Juan Miguel Bilen, The Woodlands, TX (US); Stephen Duffy, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 19/202,443

(22) Filed: May 8, 2025

(65) Prior Publication Data

US 2026/0308986 A1 Oct. 8, 2026

Related U.S. Application Data

(60) Provisional application No. 63/782,678, filed on Apr. 3, 2025.

(51) Int. Cl.
*E21B 10/61* (2006.01)

(52) U.S. Cl.
CPC ..... *E21B 10/61* (2013.01)

(58) Field of Classification Search
CPC ..... E21B 10/61; E21B 10/60; E21B 10/00
See application file for complete search history.

(56) References Cited

U.S. PATENT DOCUMENTS

| | | | | | |
|---|---|---|---|---|---|
| 4,381,825 | A * | 5/1983 | Radtke | E21B 10/61 | 175/393 |
| 4,603,750 | A * | 8/1986 | Sorenson | E21B 10/62 | 175/393 |
| 4,703,814 | A * | 11/1987 | Nguyen | E21B 10/61 | 175/393 |
| 4,793,426 | A * | 12/1988 | Millsapps, Jr. | E21B 10/62 | 239/591 |
| 5,927,410 | A * | 7/1999 | Greer | B05B 15/65 | 175/393 |
| 5,967,244 | A * | 10/1999 | Arfele | E21B 10/61 | 175/424 |
| 10,442,678 | B2 * | 10/2019 | Norman | F16K 3/246 | |
| 11,098,533 | B2 * | 8/2021 | Matthews, III | E21B 10/00 | |
| 12,326,043 | B1 * | 6/2025 | Clark | E21B 10/61 | |
| 12,345,151 | B1 * | 7/2025 | Stolboushkin | E21B 47/017 | |
| 2008/0110680 | A1 * | 5/2008 | Bilen | E21B 10/61 | 76/108.4 |
| 2008/0236899 | A1 * | 10/2008 | Oxford | E21B 10/18 | 175/339 |

(Continued)

FOREIGN PATENT DOCUMENTS

GB 2383062 A * 6/2003 ..... E21B 10/61

*Primary Examiner* — Daniel P Stephenson
(74) *Attorney, Agent, or Firm* — TraskBritt

(57) ABSTRACT

An earth-boring tool includes a tool body defining an aperture configured to receive a nozzle. The tool body defines a threaded portion extending into the aperture and an annular seal cavity extending from the aperture into the tool body. The annular seal cavity is defined by an outer wall, the outer wall includes a full width portion, a sealing surface, and an inclined surface extending between the full width portion and the sealing surface, the inclined surface extending at an angle relative to the full width portion of the outer wall.

18 Claims, 10 Drawing Sheets

(56) References Cited

U.S. PATENT DOCUMENTS

| | | | | |
|---|---|---|---|---|
| 2010/0147596 | A1* | 6/2010 | McClain | E21B 10/61<br>175/393 |
| 2010/0193253 | A1* | 8/2010 | Massey | E21B 17/1085<br>76/108.1 |
| 2017/0204675 | A1* | 7/2017 | Yu | E21B 10/61 |
| 2025/0188806 | A1* | 6/2025 | Morin | E21B 10/60 |

* cited by examiner

EARTH-BORING TOOLS, NOZZLES, AND ASSOCIATED STRUCTURES, APPARATUS, AND METHODS

CROSS-REFERENCE TO RELATED APPLICATIONS

This application claims the benefit under 35 U.S.C. § 119 (e) of U.S. Provisional Patent Application Ser. No. 63/782,678, filed Apr. 3, 2025, the disclosure of which is hereby incorporated herein in its entirety by this reference.

TECHNICAL FIELD

Embodiments of the present disclosure generally relate to earth-boring operations. In particular, embodiments of the present disclosure relate to earth-boring tools, nozzles, and associated structures, apparatus, and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors, and the earth-boring tool may be configured to drill through the plug and any slip, anchor, and other component thereof.

A fluid may be supplied into the wellbore during the wellbore drilling operation. The fluid may be used to cool and/or clean the earth-boring tool and/or related cutting elements. For example, the fluid may cool the earth-boring tool and carry cuttings and debris away from the earth-boring tool. Fluid pressure in the wellbore may be controlled to different pressures for different types of drilling operations. For example, in overbalanced drilling, the fluid pressure in the wellbore may be maintained above the pressure of the fluid in the earth formation to substantially prevent ingress of the fluids from the formation into the wellbore during the drilling operation. In some cases, the fluid pressure in the wellbore may be maintained below the fluid pressure of the formation. Lower fluid pressures may increase the efficiency of the drilling operation; however, this may allow fluid from the formation to enter the wellbore.

BRIEF SUMMARY

Embodiments of the disclosure include an earth-boring tool. The earth-boring tool includes a tool body defining an aperture configured to receive a nozzle. The tool body defines a threaded portion extending into the aperture and an annular seal cavity extending from the aperture into the tool body. The annular seal cavity is defined by an outer wall, the outer wall includes a full width portion, a sealing surface, and an inclined surface extending between the full width portion and the sealing surface, the inclined surface extending at an angle relative to the full width portion of the outer wall.

Another embodiment of the disclosure includes a nozzle for use in an earth-boring tool. The nozzle includes a body. The nozzle further includes a primary securing structure including threads extending radially from the body of the nozzle. The nozzle also includes a secondary securing structure including a seal recess defined in the body of the nozzle and axially spaced from the primary securing structure.

Other embodiments of the disclosure include a method of securing a nozzle in an earth-boring tool. The method includes disposing an annular seal in a seal cavity defined around an aperture defined in a body of the earth-boring tool. The method further includes threading the nozzle into the aperture defined in the body of the earth-boring tool. The method also includes aligning a seal recess defined in the nozzle with the seal cavity. The method further includes applying a fluid pressure from an inlet side of the nozzle to the annular seal. The method also includes disposing the annular seal partially into the seal recess through the fluid pressure, such that the annular seal contacts a sealing surface in each of the seal cavity and the seal recess.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring system or component thereof, but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (eg., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met. In another example, an angle that is substantially met may be within about +/−15°, within about +/−10°, within about +/−5°, or even within about 0°.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As discussed above, a fluid may be supplied into the wellbore during the wellbore drilling operation. The fluid is supplied through nozzles in the earth-boring tool. Vibrations inherent in the drilling operations may cause the nozzles to loosen and fall out of the earth-boring tool, which may reduce the efficiency and/or control of the fluid delivery. Embodiments of the disclosure provide a nozzle assembly that includes a secondary securing mechanism configured to prevent the nozzles from loosening during a drilling operation.

Figure 1:
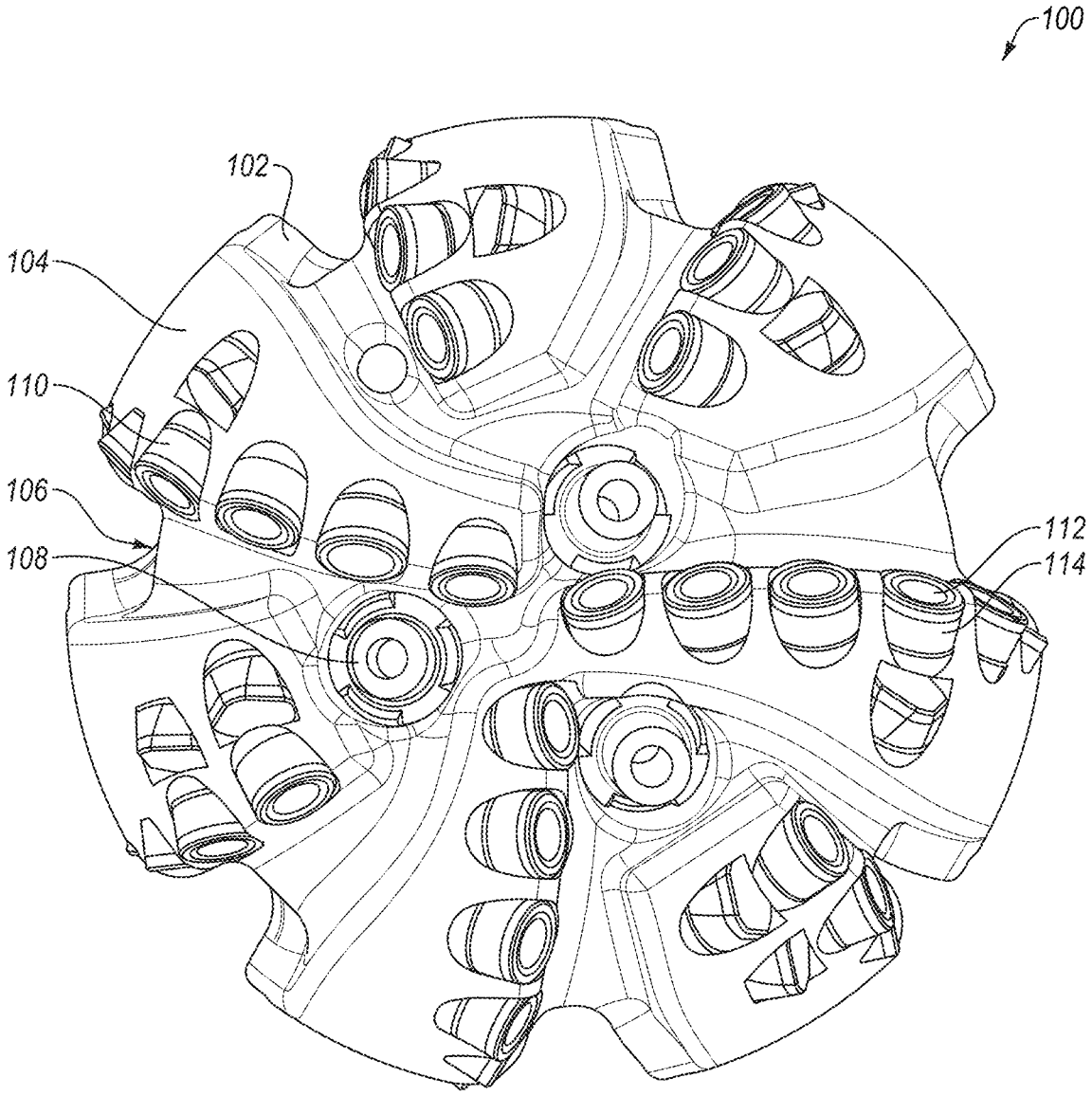
FIG. 1 illustrates a front view of an earth-boring tool in accordance with embodiments of the disclosure.
Figure 2:
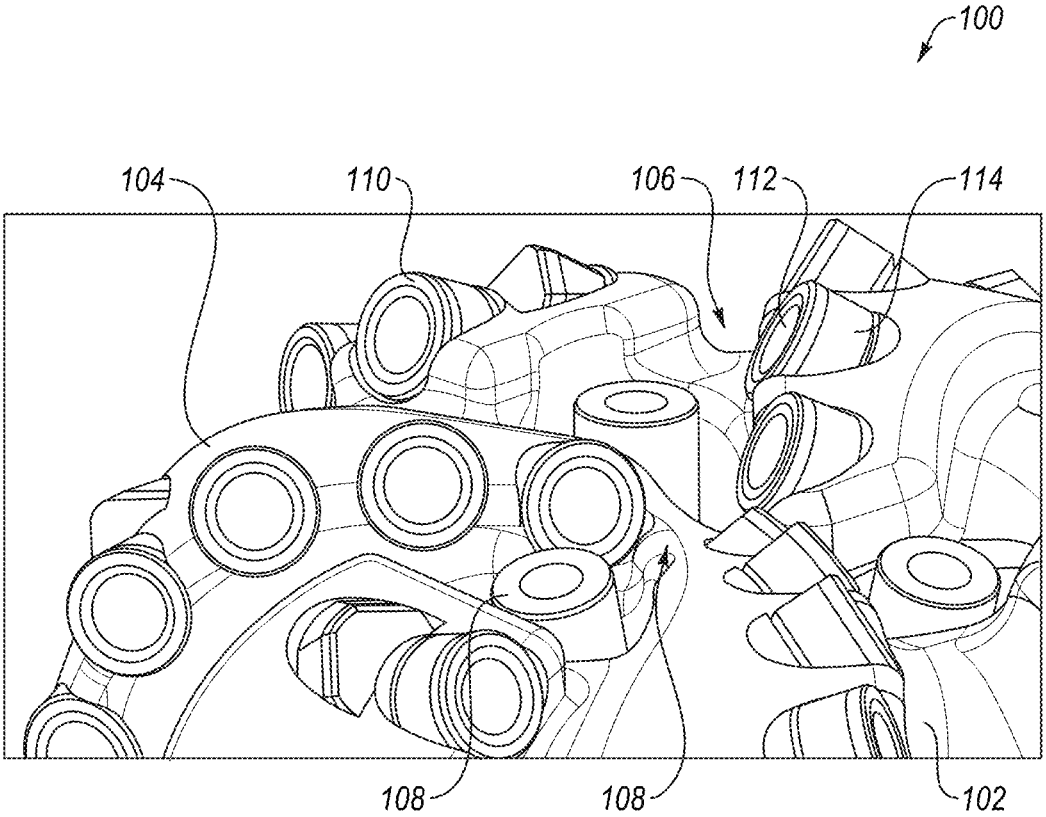
FIG. 2 illustrates an enlarged view of a portion of the earth-boring tool of FIG. 1.

FIGS. 1 and 2, are views of an earth-boring tool 100. The earth-boring tool 100 includes a tool body 102 including blades 104 in which a plurality of cutting elements 110 are secured. The cutting elements 110 include a cutting table defining a cutting face 112 which may form the cutting edge of the blade 104. The cutting elements 110 also include a substrate 114 configured to support the cutting table. The substrate 114 may be secured to a cutting pocket in the blade 104, such as through welding, soldering, brazing, etc., securing the cutting elements 110 to the blade 104.

The earth-boring tool 100 rotates about a longitudinal axis of the earth-boring tool 100. When the earth-boring tool 100 rotates the cutting face 112 of the cutting elements 110 contact the earth formation and remove material. The material removed by the cutting faces 112 may then be removed through the junk slots 106. The tool body 102 also includes nozzles 108 installed in the tool body 102, which introduce fluid, such as water or drilling mud, into the area around the blades 104 to aid in removing the sheared material and other debris from the area around the blades 104 and/or to cool the cutting elements 110 and the blade 104 to increase the efficiency of the earth-boring tool 100.

The fluid enters the wellbore through the nozzles 108. The nozzles 108 may be coupled to a pressurized fluid supplied through the drill string. The pressure of the fluid in the borehole may be controlled through the pressure of the fluid being supplied through the drill string and the nozzles 108.

Figure 3:
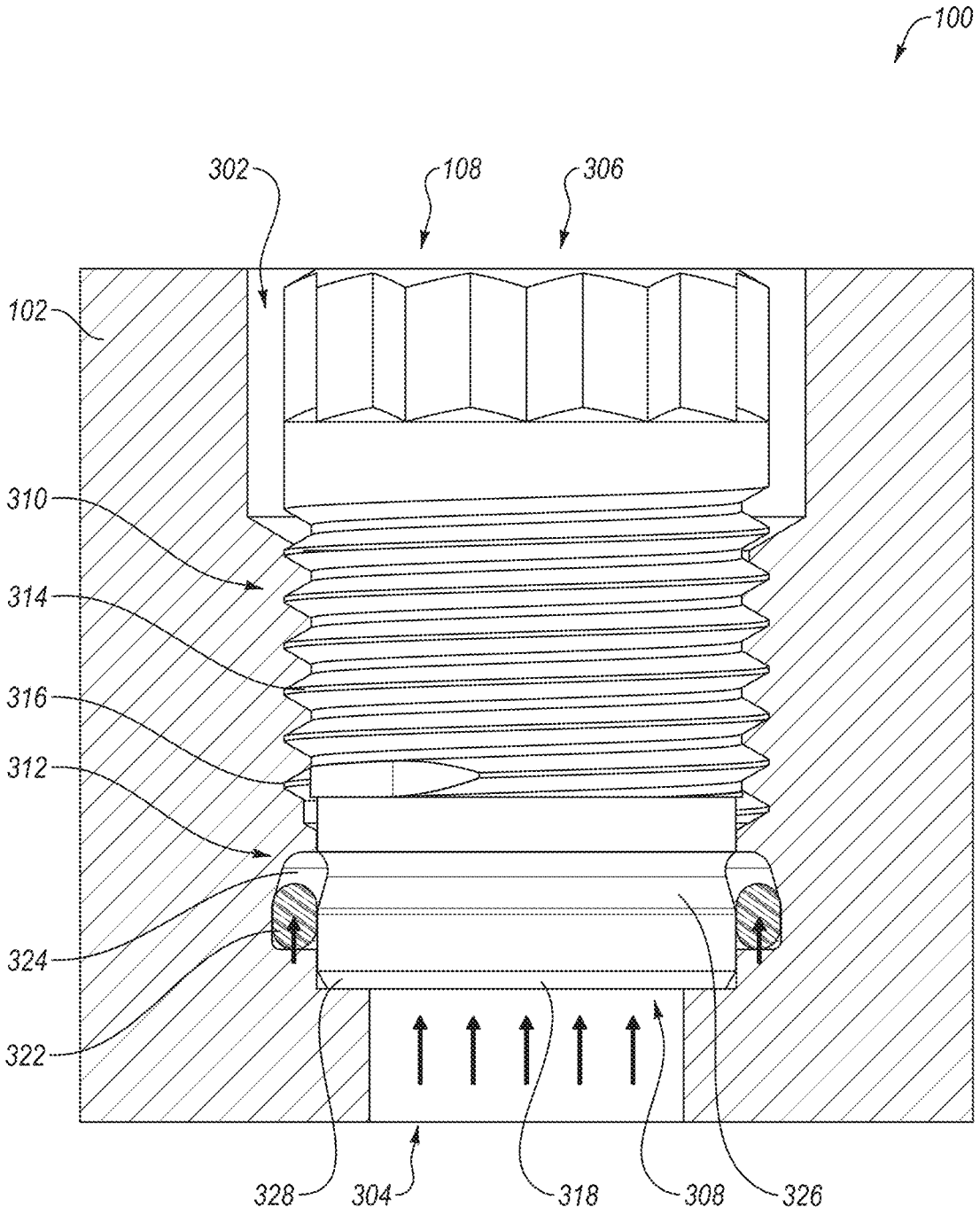
FIG. 3 illustrates an enlarged sectional view of the earth-boring tool of FIG. 1, illustrating an embodiment of a nozzle disposed in the earth-boring tool in accordance with embodiments of the disclosure.

FIG. 3 illustrates an enlarged cross-section of the earth-boring tool 100 where the nozzle 108 is coupled to the tool body 102 of the earth-boring tool 100. The tool body 102 includes an aperture 302 configured to receive the nozzle 108. The aperture 302 is operatively connected to a fluid passage 304 defined within the tool body 102. The fluid passage 304 may be operatively coupled to the pressurized fluid supplied through the drill string. Thus, the fluid passage 304 may supply the pressurized fluid to the nozzle 108 installed in the aperture 302 of the tool body 102.

The nozzle 108 includes an outlet 306 positioned outside the tool body 102 and an inlet 308 positioned within the tool body 102 proximate the fluid passage 304. The pressurized fluid is supplied to the nozzle 108 through the inlet 308 and the pressurized fluid exits the nozzle 108 through the outlet 306. The nozzle 108 may be configured to concentrate the fluid in a position proximate the cutting elements 110 (FIG. 1) to clear debris from around the cutting elements 110 (FIG. 1) and/or to cool the cutting elements 110 (FIG. 1). The nozzle 108 may also be configured to jet the pressurized fluid, such as by reducing a cross-sectional area of the fluid passage within the nozzle 108 causing the velocity of the pressurized fluid to increase as the fluid passes through the nozzle 108.

The nozzle 108 is secured to the tool body 102 of the earth-boring tool 100 through a primary securing interface 310. In the embodiment illustrated in FIG. 3, the nozzle 108 is also secured to the tool body 102 of the earth-boring tool 100 through a secondary securing interface 312. The secondary securing interface 312 may be configured to inhibit any loosening or backing out of the primary securing interface 310 that may be caused by vibrations during the drilling operations.

The primary securing interface 310 may include interlocking threads 314 and complementary threads 316. The threads 314 defined on the nozzle 108 are configured to engage the complementary threads 316 defined in the tool body 102. As the nozzle 108 is rotated, the engagement between the threads 314 and the complementary threads 316 causes the nozzle 108 to move into the aperture 302 defined in the tool body 102. Once an inlet end 318 of the nozzle 108 reaches a bottom 320 of the aperture 302, further rotation of the nozzle 108 may induce an axial clamping force between the threads 314 and the complementary threads 316 to form the primary securing interface 310. As discussed above, vibrations of the earth-boring tool 100 during drilling operations may cause the nozzle 108 to slowly rotate. The rotation of the nozzle 108 may reduce the clamping force between the threads 314 and the complementary threads 316 until the nozzle 108 begins to unthread from the aperture 302. In some cases, the vibrations may cause the nozzle 108 to be completely removed from the aperture 302.

The secondary securing interface 312 is configured to secure the nozzle 108 to the tool body 102 axially in a manner that cannot be released through rotation. Thus, the secondary securing interface 312 is configured to substantially prevent the primary securing interface 310 from loosening under vibration. The secondary securing interface 312 illustrated in FIG. 3 includes an annular seal 322 configured to form an interface between a seal cavity 324 defined in the aperture 302 of the tool body 102 and a seal recess 326 defined in the nozzle 108. The annular seal 322 may be a flexible seal, such as an O-ring. The annular seal 322 may be formed from flexible materials, such as rubber or flexible polymers (e.g., Nitrile, Neoprene, Ethylene Propylene (EPDM Rubber), Silicone, Fluorocarbon, etc.).

In the embodiment illustrated in FIG. 3, the annular seal 322 has a substantially round cross-section. In other embodiments, the annular seal 322 may have different cross-sectional shapes, such as triangular shapes, rectangular shape, or combinations thereof, such as a rectangular side combined with a round side (e.g., a "D" shape). In some embodiments the annular seal 322 may have a complex cross-sectional shape, such as a combination of ribs, notches, and sealing surfaces.

Figure 4:
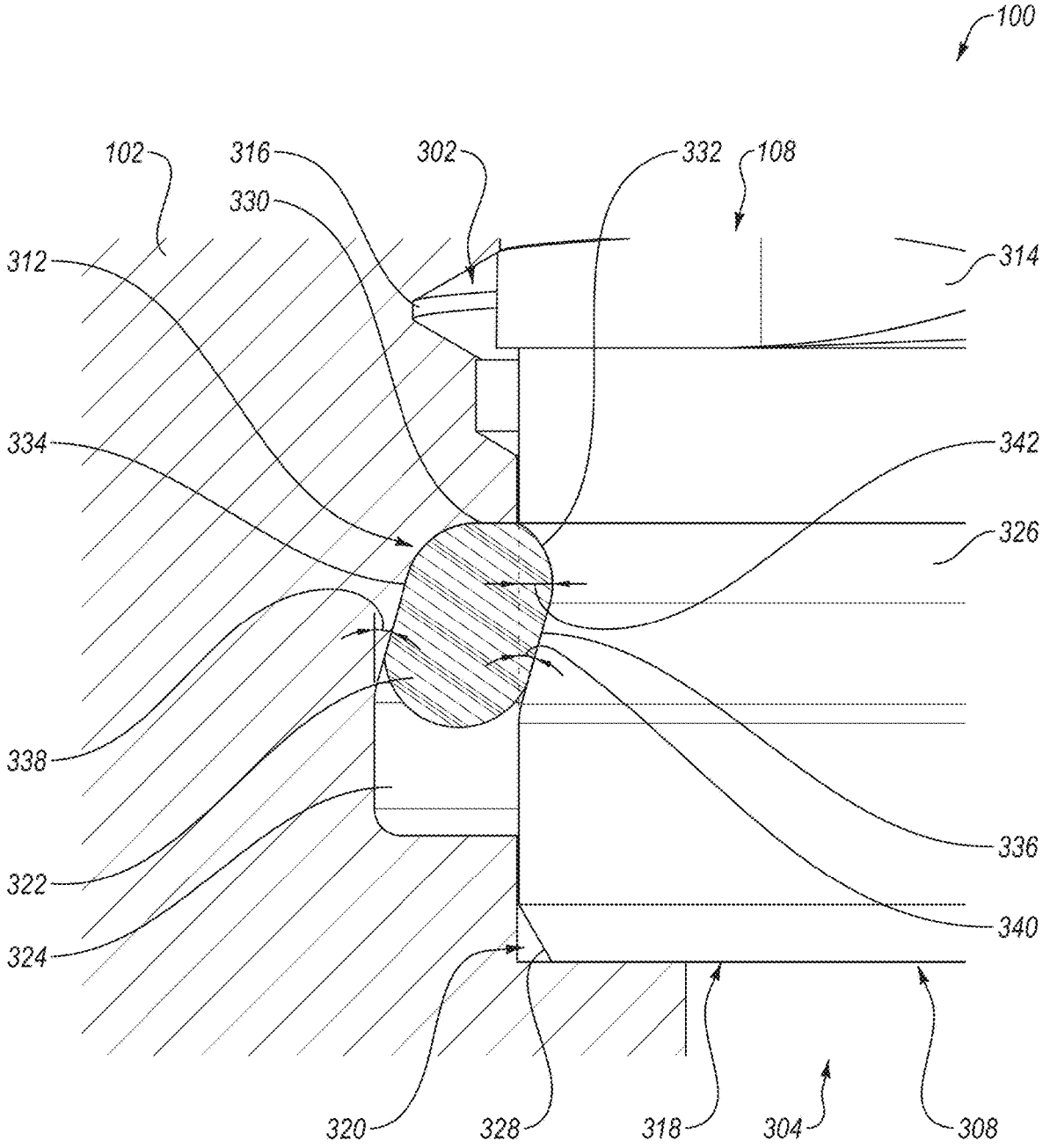
FIG. 4 illustrates an enlarged view of the nozzle disposed in the earth-boring tool illustrated in FIG. 3.

In some embodiments, the annular seal 322 may include multiple annular seals 322 axially offset from one another, such that each annular seal 322 may perform different functions. For example, a first annular seal 322 may be configured to form the secondary securing interface 312 and a second annular seal 322 may be configured to form a fluid seal. The annular seals 322 may be formed from different materials based on their desired function. For example, the annular seal 322 configured to form the secondary securing interface 312 may be formed from a stronger less flexible material, such as a polymer (e.g., polytetrafluoroethylene (PTFE), high-density polyethylene (HDPE), etc.), silicon, or composite materials, while the annular seal 322 configured to form a fluid seal may be formed from a more flexible material, such as rubber, silicone rubber, FIG. 4 illustrates an enlarged view of the secondary securing interface 312 between the nozzle 108 and the tool body 102 of the earth-boring tool 100. The annular seal 322 is configured to move axially within the seal cavity 324 when a pressure is applied to the seal cavity 324 by the pressurized fluid being supplied by the fluid passage 304. The pressurized fluid passes between the nozzle 108 and the tool body 102, such as between the inlet end 318 of the nozzle 108 and the bottom 320 of the aperture 302 defined in the tool body 102 and into the seal cavity 324. The inlet end 318 of the nozzle 108 may include a chamfer 328. The chamfer 328 may be configured to facilitate easier assembly and/or disassembly of the earth-boring tool 100, such as by facilitating the ingress of the nozzle 108 into the aperture 302 of the tool body 102. The chamfer 328 may also be configured to direct a small portion of the pressurized fluid to a radially outer portion of the nozzle 108 and into the seal cavity 324.

The pressure applied by the pressurized fluid may cause the annular seal 322 to rise axially within the seal cavity 324 and partially into the seal recess 326 defined in the nozzle 108. Once the annular seal 322 rises partially into the seal recess 326, the annular seal 322 forms an interface with both a sealing surface 330 of the seal cavity 324 and a sealing surface 332 of the seal recess 326. The pressure applied by the pressurized fluid may cause the annular seal 322 to conform to the sealing surface 330 and the sealing surface 332 forming a fluid seal between the annular seal 322 and the sealing surfaces 330, 332. A cross-section of the sealing surfaces 330, 332 may define a curved shape. The curved shape may be complementary to a curved shape of a cross-section of the annular seal 322. The shape of the sealing surfaces 330, 332 may increase a contact area between the annular seal 322 and the sealing surfaces 330, 332 to facilitate an improved seal between the annular seal 322 and the seal cavity 324 and the seal recess 326.

In the embodiment illustrated in FIGS. 3 and 4, the seal cavity 324 includes an inclined surface 334 at a transition between a full width portion of the seal cavity 324 and the sealing surface 330 of the seal cavity 324. The inclined surface 334 may be configured to direct the annular seal 322 into the seal recess 326 of the nozzle 108 as the annular seal 322 rises axially in the seal cavity 324. The seal recess 326 includes a complementary inclined surface 336 configured to receive the annular seal 322 as the annular seal 322 rises axially in the seal cavity 324 and is directed into the seal recess 326 by the inclined surface 334. An angle 338 of the inclined surface 334 relative to the axial direction is substantially the same as an angle 340 of the inclined surface 336 relative to the axial direction, such that the inclined surface 334 and the inclined surface 336 are substantially parallel. The angles 338, 340 may be in a range from about 10° to about 80°, such as from about 20° to about 60°.

The pressurized fluid may cause the annular seal 322 to move until the annular seal 322 is fully seated within the seal recess 326. When the annular seal 322 is fully seated in the seal recess 326, the annular seal 322 is positioned to have an overlap 342 into the cross-sectional area of the nozzle 108. The overlap 342 may be in a range from about 10% of the cross-sectional area of the annular seal 322 to about 50% of the cross-sectional area of the annular seal 322, such as from about 10% of the cross-sectional area of the annular seal 322 to about 30% of the cross-sectional area of the annular seal 322. The overlap 342 results in a portion of the annular seal 322 being compressed into the seal recess 326 within a cross-sectional area of the nozzle 108 while another portion of the annular seal 322 is compressed into the sealing surface 330 of the seal cavity 324 outside the cross-sectional area of the nozzle 108. Thus, the annular seal 322 serves to impede axial movement of the nozzle 108 through interference between the annular seal 322 and the seal recess 326. The pressure of the pressurized fluid on the lower portion of the annular seal 322 is configured to maintain the annular seal 322 seated within the seal recess 326, such that the pressure of the pressurized fluid impedes axial movement of the annular seal 322 to maintain the interference between the annular seal 322 and the seal recess 326.

The annular seal 322 is configured to both create a fluid seal at the sealing surfaces 330, 332 and to retain the nozzle 108 axially within the aperture 302 of the tool body 102. The fluid seal formed by the annular seal 322 and the sealing surfaces 330, 332 may substantially prevent the pressurized fluid from passing into the threads 314 and the complementary threads 316 positioned axially above the annular seal 322. Thus, the fluid seal may substantially prevent wear and/or damage to the threads 314 and the complementary threads 316 that may be caused by the pressurized fluid and/or abrasive or particle materials suspended therein. The fluid seal may also be configured to reduce pressure losses from the pressurized fluid around the nozzle 108, such that the pressure of the pressurized fluid may be maintained and concentrated into the fluid passage through the nozzle 108 and out the outlet 306 (FIG. 3).

When the pressure of the pressurized fluid is removed, the nozzle 108 may be removed by unthreading the nozzle 108 (e.g., rotating the nozzle 108 in an opposite direction from the direction the nozzle 108 was rotated during installation). As the nozzle 108 moves axially upward under the axial force induced by the engagement of the threads 314 and the complementary threads 316, the inclined surface 336 of the seal recess 326 may move the annular seal 322 radially away from the seal recess 326 and axially down in the seal cavity 324. With the pressure from the pressurized fluid removed, the resistance to the movement of the annular seal 322 may be reduced, such that the nozzle 108 may move axially more easily. Thus, the secondary securing interface 312 formed by the annular seal 322 is substantially released when the pressure from the pressurized fluid is released.

Figure 5:
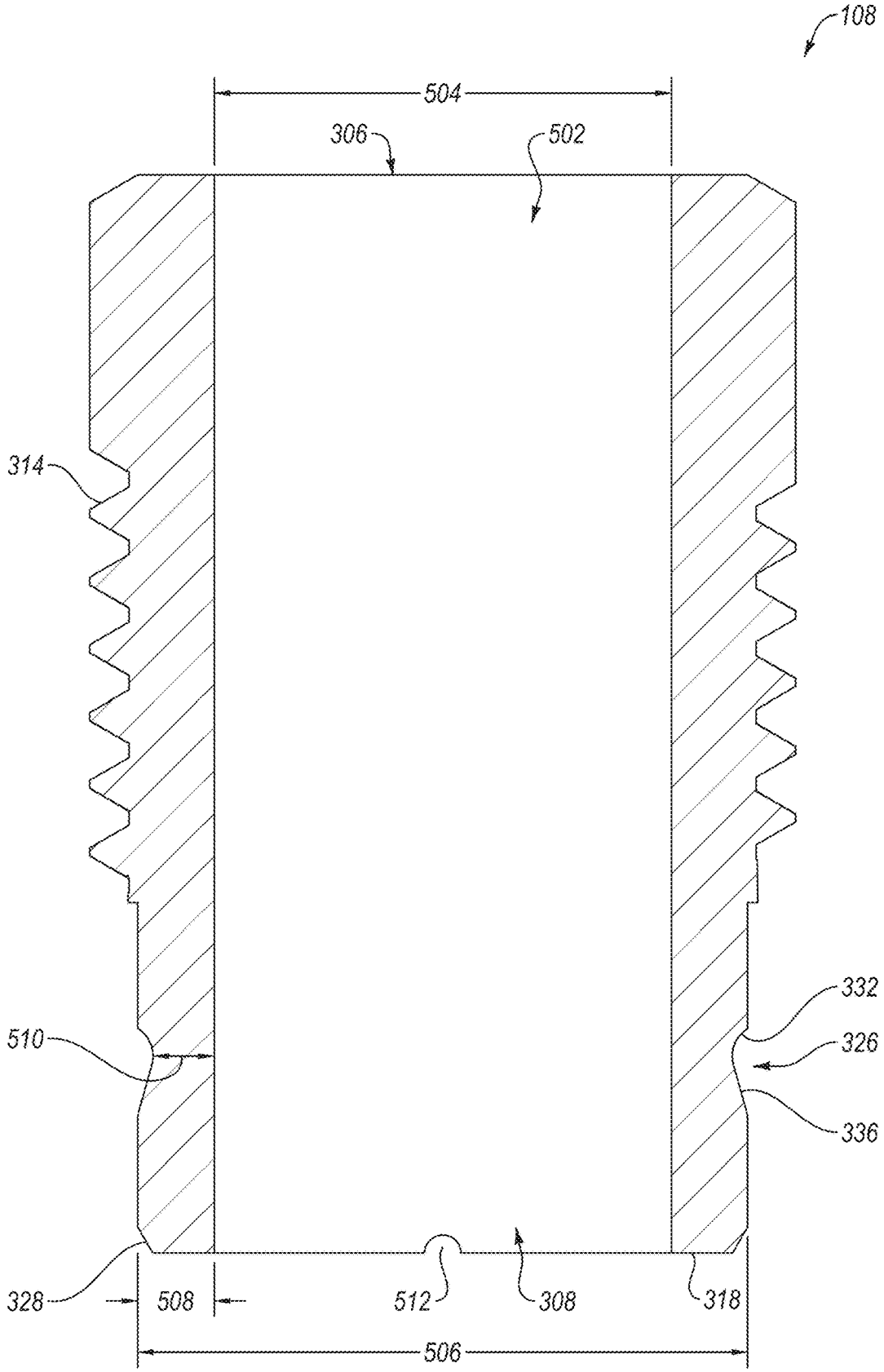
FIG. 5 illustrates a cross-sectional view of the nozzle of FIG. 3 in accordance with embodiments of the disclosure.

FIG. 5 illustrates a cross-sectional view of the nozzle 108. As discussed above, the nozzle 108 defines a fluid passage 502 extending through the nozzle 108 between the inlet 308 and the outlet 306. The fluid passage 502 has a major dimension 504 (e.g., diameter, width, apothem, etc.). A larger major dimension 504 may facilitate a greater volume of flow of the pressurized fluid, whereas a smaller major dimension 504 may restrict the volume of flow of the pressurized fluid. In different applications, such as different drilling operations or different positions on a same earth-boring tool 100 (FIG. 1), different volumes of flow may provide different benefits. For example, in a nose region of the earth-boring tool 100 (FIG. 1) a different volume of flow may be desirable in comparison with a shoulder region of the earth-boring tool 100. Therefore, the nozzles 108 in the nose region of the earth-boring tool 100 (FIG. 1) may define fluid passages 502 with a different major dimension 504 from the nozzles 108 directed to the shoulder regions of the earth-boring tool 100 (FIG. 1). Similarly, different types of earth formations may benefit differently from different flow volumes. For example, loose formations, such as sand, gravel, or clay, may benefit from higher volumes and low velocity flow while dense formations, such as sandstone, shale, or granite, may benefit from lower flow volumes and higher velocity flow. Thus, nozzles 108 defining fluid passages 502 with larger major dimensions 504 may be used in loose formations and nozzles 108 defining fluid passages 502 with smaller major dimensions 504 may be used in dense formations. In some embodiments, the major dimension 504 of the fluid passage 502 defined by the nozzle 108 changes between the inlet 308 and the outlet 306. For example, the major dimension 504 of the fluid passage 502 may be larger at the inlet 308 and smaller at the outlet 306 to create a jetting effect on the pressurized fluid passing through the fluid passage 502.

An outer major dimension 506 of the inlet end 318 of the nozzle 108 is defined by the aperture 302 (FIG. 3) of the tool body 102 (FIG. 3). Therefore, as the major dimension 504 of the fluid passage 502 increases a wall thickness 508 of the nozzle 108 at the inlet end 318 of the nozzle 108 will decrease. As discussed above, the seal recess 326 creates a space within the cross-section of the nozzle 108 to receive the annular seal 322 (FIG. 3). The space created by the seal recess 326 may also define a wall thickness 510 that is less than the wall thickness 508 of the nozzle 108 at the inlet end 318.

Figure 6:
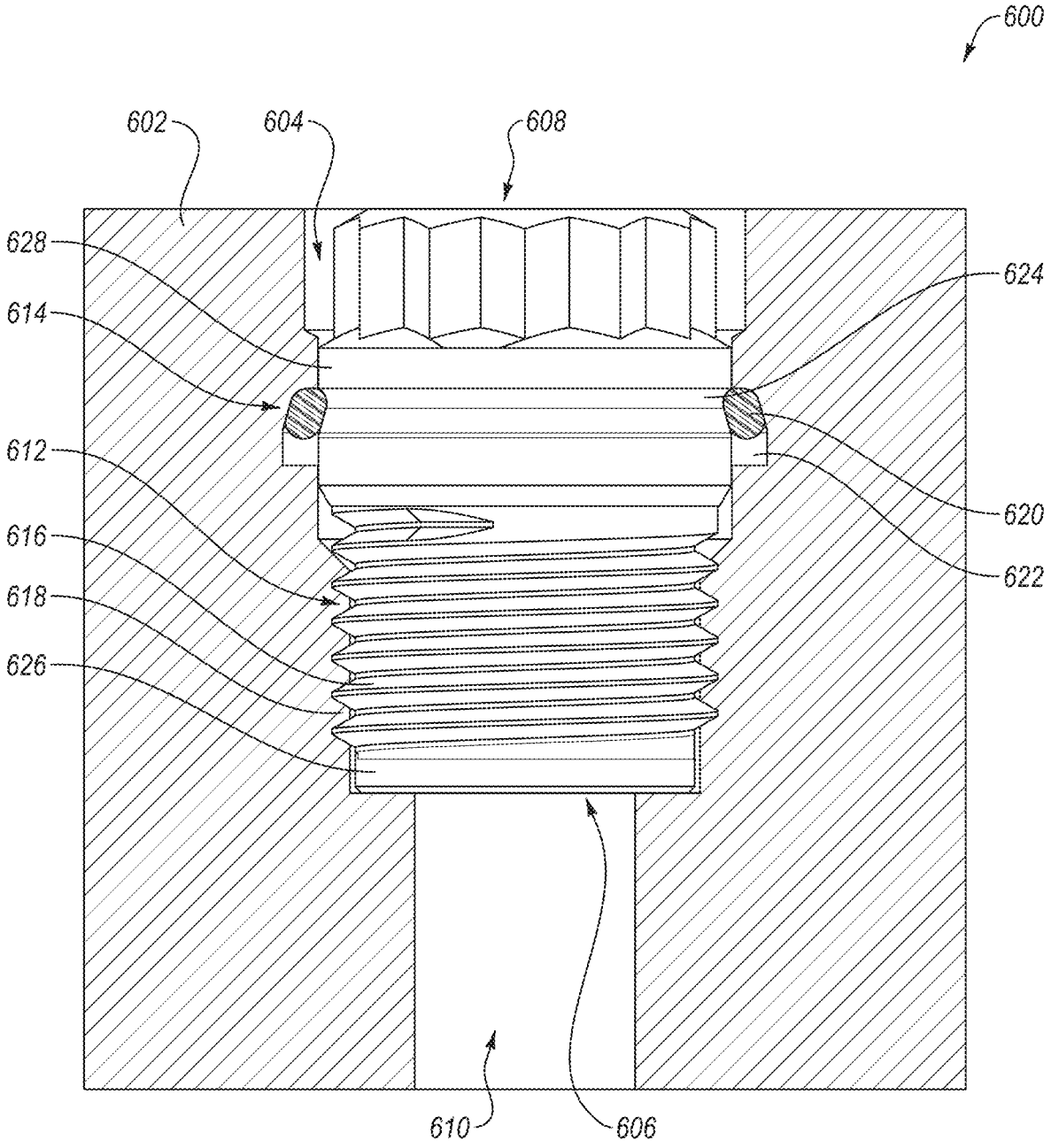
FIG. 6 illustrates an embodiment of a nozzle disposed in an earth-boring tool in accordance with embodiments of the disclosure.
Figure 7:
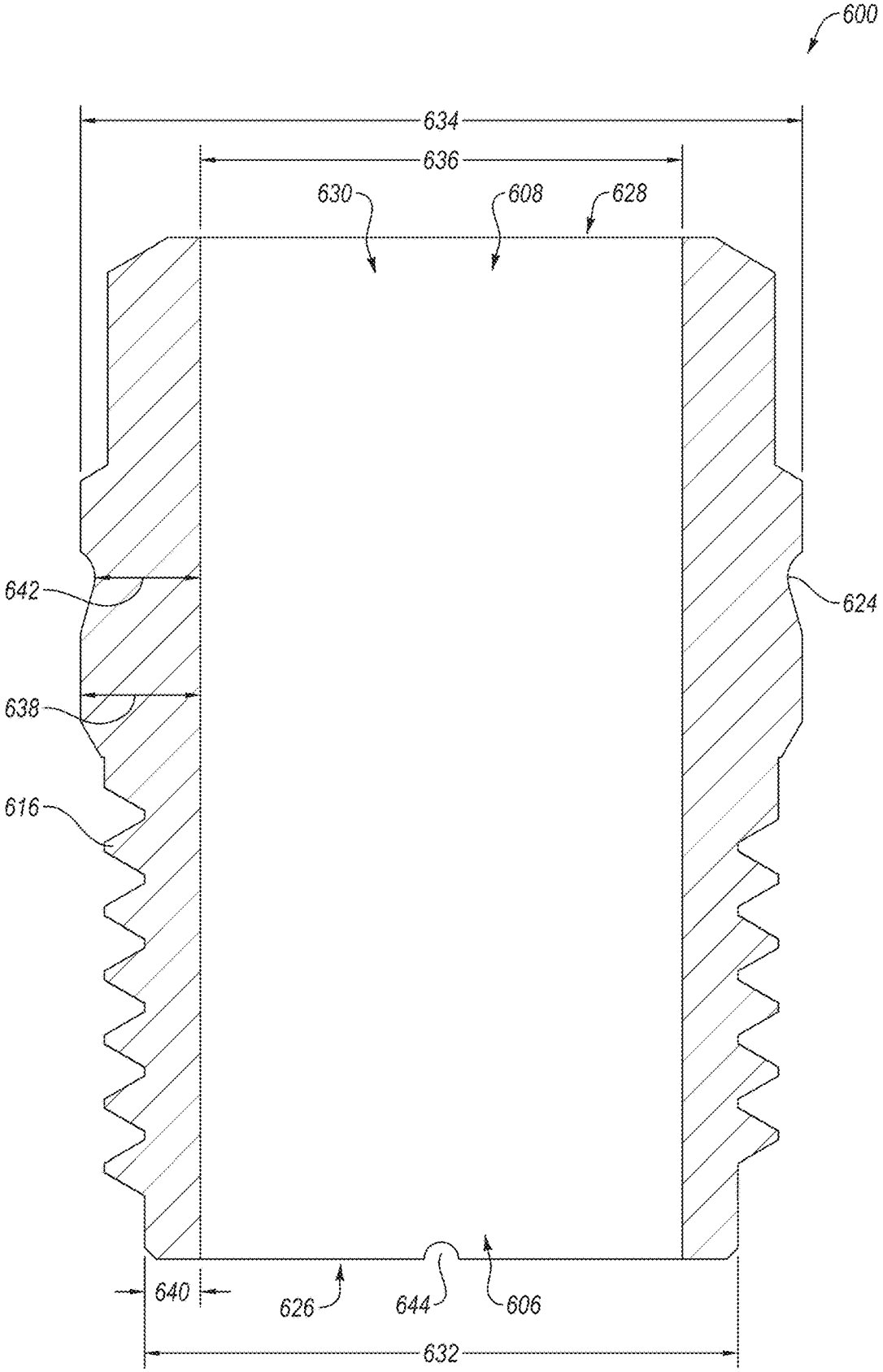
FIG. 7 illustrates a cross-sectional view of the nozzle of FIG. 6 in accordance with embodiments of the disclosure.

In some embodiments the nozzle 108 includes a passage 512 defined between the fluid passage 502 and the outer portion of the nozzle 108 through the chamfer 328 at the inlet end 318 of the nozzle 108. The passage 512 may facilitate passing a greater amount of the pressurized fluid to the seal recess 326 and the seal cavity 324. This may facilitate a faster actuation of the annular seal 322 into the seal recess 326 and a faster release of the fluid pressure in the seal cavity 324 when the flow of pressurized fluid through the fluid passage 502 is stopped. In some embodiments, multiple passages 512 are arranged about the perimeter of the fluid passage 502, such as two passages 512, three passages 512, four passages 512, etc. Multiple passages 512 may facilitate a more even distribution of the pressurized fluid within the seal cavity 324. FIGS. 6 and 7 illustrate an embodiment of a nozzle 600. FIG. 6 illustrates the nozzle 600 installed in an earth-boring tool, such as earth-boring tool 100 (FIG. 1). The nozzle 600 is disposed in an aperture 604 defined by a tool body 602. The nozzle 600 includes an inlet 606 and an outlet 608 and is configured to receive a pressurized fluid from a fluid passage 610 defined in the tool body 602 and output the pressurized fluid through the outlet 608. The nozzle 600 is secured to the tool body 602 through a primary securing interface 612 and a secondary securing interface 614.

In the embodiment illustrated in FIGS. 6 and 7 the primary securing interface 612 includes threads 616 defined on the nozzle 600 that interface with complementary threads 618 defined in the aperture 604 of the tool body 602. The secondary securing interface 614 is created by interference between an annular seal 620 and a seal cavity 622 defined in the tool body 602 and a seal recess 624 defined in the nozzle 600.

In the embodiment illustrated in FIGS. 6 and 7 the primary securing interface 612 is arranged proximate an inlet end 626 of the nozzle 600 and the secondary securing interface 614 is arranged proximate an outlet end 628 of the nozzle 600. The pressurized fluid may pass through the area of the threads 616 and the complementary threads 618 to reach the seal cavity 622. The seal cavity 622 and the seal recess 624 define a similar cross-sectional shape to the shape of the seal cavity 324 and the seal recess 326 described above, with respect to FIG. 3. For example, the seal cavity 622 and the seal recess 624 include parallel inclined surfaces configured to direct the annular seal 620 into the seal recess 624 when a pressure is applied by the pressurized fluid. When the annular seal 620 is directed into the seal recess 624, a portion of the annular seal 620 overlaps into the cross-sectional area of the nozzle 600 creating an interference that serves to impede axial movement of the nozzle 600 through the interference between the annular seal 620 and the seal recess 624.

The annular seal 620 is also configured to compress against sealing surfaces of the seal cavity 622 and the seal recess 624 to substantially prevent the pressurized fluid from passing axially beyond the annular seal 620 to maintain the pressure of the pressurized fluid in the area axially below the nozzle 600, which may maximize the volume and pressure of the pressurized fluid passing through a fluid passage 610 of the nozzle 600. The annular seal 620 compressing against the sealing surfaces of the seal cavity 622 and the seal recess 624 may also substantially prevent pressurized fluids in the wellbore outside the earth-boring tool from passing between the nozzle 600 and the tool body 602 and contaminating the pressurized fluid being supplied by the fluid passage 610 and/or damaging internal components of the associated earth-boring tool.

In some embodiments the nozzle 600 includes a passage 644 defined between the fluid passage 610 and the outer portion of the nozzle 600 at the inlet end 626 of the nozzle 600. The passage 644 may facilitate passing a greater amount of the pressurized fluid to the seal recess 624 and the seal cavity 622. This may facilitate a faster actuation of the annular seal 620 into the seal recess 624 and a faster release of the fluid pressure in the seal cavity 622 when the flow of pressurized fluid through the fluid passage 610 is stopped. In some embodiments, multiple passages 644 are arranged about the perimeter of the fluid passage 610. Multiple passages 644 may facilitate a more even distribution of the pressurized fluid within the seal cavity 622.

FIG. 7 illustrates a cross-section of the nozzle 600. As discussed above, the threads 616 of the nozzle 600 are positioned proximate the inlet end 626 and the seal recess 624 of the nozzle 600 is positioned proximate the outlet end 628. As discussed above, an outer major dimension 632 of inlet end 626 of the nozzle 600 is defined by the aperture 604 of the tool body 602. Similarly, an outer major dimension 634 of the nozzle 600 proximate the outlet end 628 of the nozzle 600 is also defined by the aperture 604 of the tool body 602. To accommodate the threads 616 of the nozzle 600, the space defined by the aperture 604 proximate the outlet end 628 has a larger major dimension than the major diameter of the threads 616. Similarly, to pass through the complementary threads 618 defined in the tool body 602, the outer major dimension 632 of the nozzle 600 proximate the inlet end 626 is smaller than the minor diameter of the threads 616. Therefore, the outer major dimension 634 of the nozzle 600 proximate the outlet end 628 is larger than the outer major dimension 632 of the nozzle 600 proximate the inlet end 626.

The respective outer major dimensions 634, 632 of the nozzle 600 combined with a major dimension 636 of the fluid passage 630 through the nozzle 600 may combine to define wall thicknesses 638, 640 of the nozzle 600 at the inlet end 626 and the outlet end 628. The larger outer major dimension 634 of the nozzle 600 proximate the outlet end 628 may result in the nozzle 600 having a larger wall thickness 638 proximate the outlet end 628 than the wall thickness 640 of the nozzle 600 proximate the inlet end 626.

In the embodiment illustrated in FIGS. 6 and 7, the seal recess 624 is positioned in the region of the nozzle 600 proximate the outlet end 628, such that the seal recess 624 is defined in the wall of the nozzle 600 having the larger wall thickness 638. The seal recess 624 results in a reduced wall thickness 642. However, because the wall thickness 638 of the nozzle 600 in the region proximate the fluid passage 630 is larger than the wall thickness 640 of the nozzle 600 in the region proximate the inlet end 626, the reduced wall thickness 642 defined by the seal recess 624 is also larger than the wall thickness 640 of the nozzle 600 in the region proximate the inlet end 626.

Figure 8:
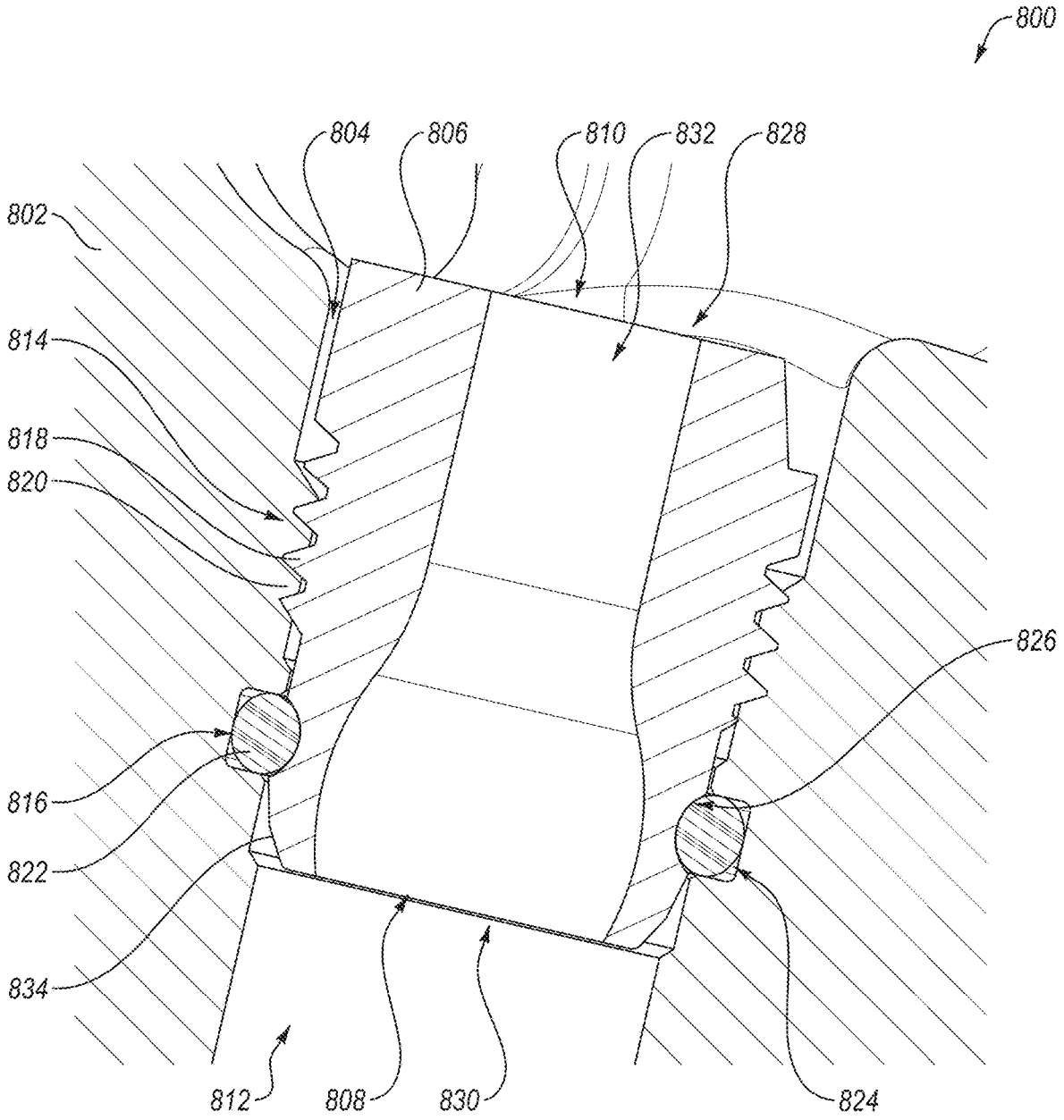
FIG. 8 illustrates an embodiment of a nozzle disposed in an earth-boring tool in accordance with embodiments of the disclosure.
Figure 9:
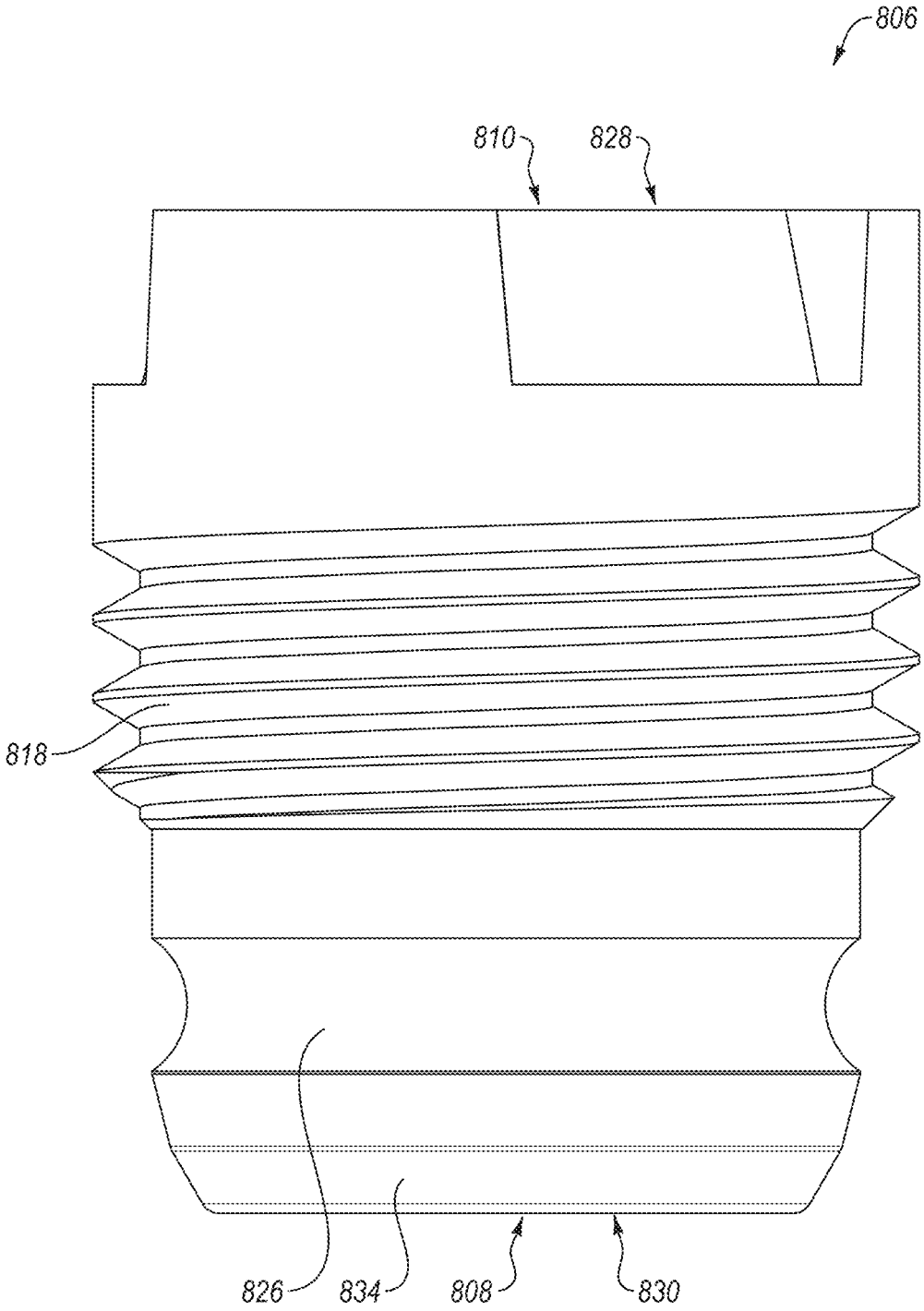
FIG. 9 illustrates an enlarged view of the nozzle of FIG. 8 in accordance with embodiments of the disclosure.

FIGS. 8 and 9 illustrate an embodiment of an earth-boring tool 800 including a nozzle 806. FIG. 8 illustrates the nozzle 806 disposed in an aperture 804 defined by a tool body 802. The nozzle 806 includes an inlet 808 and an outlet 810 and is configured to receive a pressurized fluid from a fluid passage 812 defined in the tool body 802 and output the pressurized fluid through the outlet 810. The nozzle 806 is secured to the tool body 802 through a primary securing interface 814 and a secondary securing interface 816.

In the embodiment illustrated in FIGS. 8 and 9 the primary securing interface 814 includes threads 818 defined on the nozzle 806 that interface with complementary threads 820 defined in the aperture 804 of the tool body 802. The secondary securing interface 816 is created by interference between an annular seal 822 and a seal cavity 824 defined in the tool body 802 and a seal recess 826 defined in the nozzle 806.

In the embodiment illustrated in FIGS. 8 and 9 the primary securing interface 814 is arranged proximate an outlet end 828 of the nozzle 600 and the secondary securing interface 816 is arranged proximate an inlet end 830 of the nozzle 806. The annular seal 822 of the secondary securing interface 816 is an oversized flexible seal, such as an oversized O-ring. The annular seal 822 is configured to have an interference fit with the outer surface of the nozzle 806, such that when the seal recess 826 is aligned with the seal cavity 824, the oversized annular seal 822 expands into the seal recess 826, substantially filling both the seal recess 826 and the seal cavity 824. The nozzle 806 includes a taper 834 (e.g., a frustoconical structure) defined in the outer surface of the nozzle 806 proximate the inlet end 830 of the nozzle 806. The taper 834 may be configured to facilitate moving the nozzle 806 axially through the oversized annular seal 822 during installation. In some embodiments, the taper 834 is a chamfer having a constant angle, such as an angle in a range from about 30° to about 60°. In other embodiments, the taper 834 is formed from multiple graduated chamfers or angled surfaces. In other embodiments, the taper 834 is formed from a radiused surface defining an arcuate shape in a cross-section of the surface of the taper 834.

When the nozzle 806 is threaded into the aperture 804 of the tool body 802, the axially downward force generated by the engagement of the threads 818 and the complementary threads 820 may push the inlet end 830 of the nozzle 806 through the oversized annular seal 822. The taper 834 may apply a radially outward force on the oversize annular seal 822, such that the oversized annular seal 822 is compressed into the seal cavity 824 until the seal recess 826 of the nozzle 806 is aligned with the seal cavity 824. Once the seal recess 826 and the seal cavity 824 are axially aligned, the oversized annular seal 822 may substantially fill the seal recess 826, as discussed above, creating an overlap of the oversized annular seal 822 into the cross-sectional area of both the nozzle 806 and the tool body 802. The overlap of the annular seal 822 may be configured to restrict axial movement of the nozzle 806 relative to the tool body 802 providing the secondary securing interface 816.

As discussed above, the annular seal 822 is also configured to compress against sealing surfaces of the seal cavity 824 and the seal recess 826 to substantially prevent the pressurized fluid from passing axially beyond the annular seal 822 to maintain the pressure of the pressurized fluid in the area axially below the nozzle 806, which may maximize the volume and pressure of the pressurized fluid passing through a fluid passage 832 of the nozzle 806. The annular seal 822 compressing against the sealing surfaces of the seal cavity 824 and the seal recess 826 may also substantially prevent pressurized fluids in the wellbore outside the earth-boring tool from passing between the nozzle 806 and the tool body 802 and contaminating the pressurized fluid being supplied by the fluid passage 812 and/or damaging internal components of the associated earth-boring tool.

Figure 10:
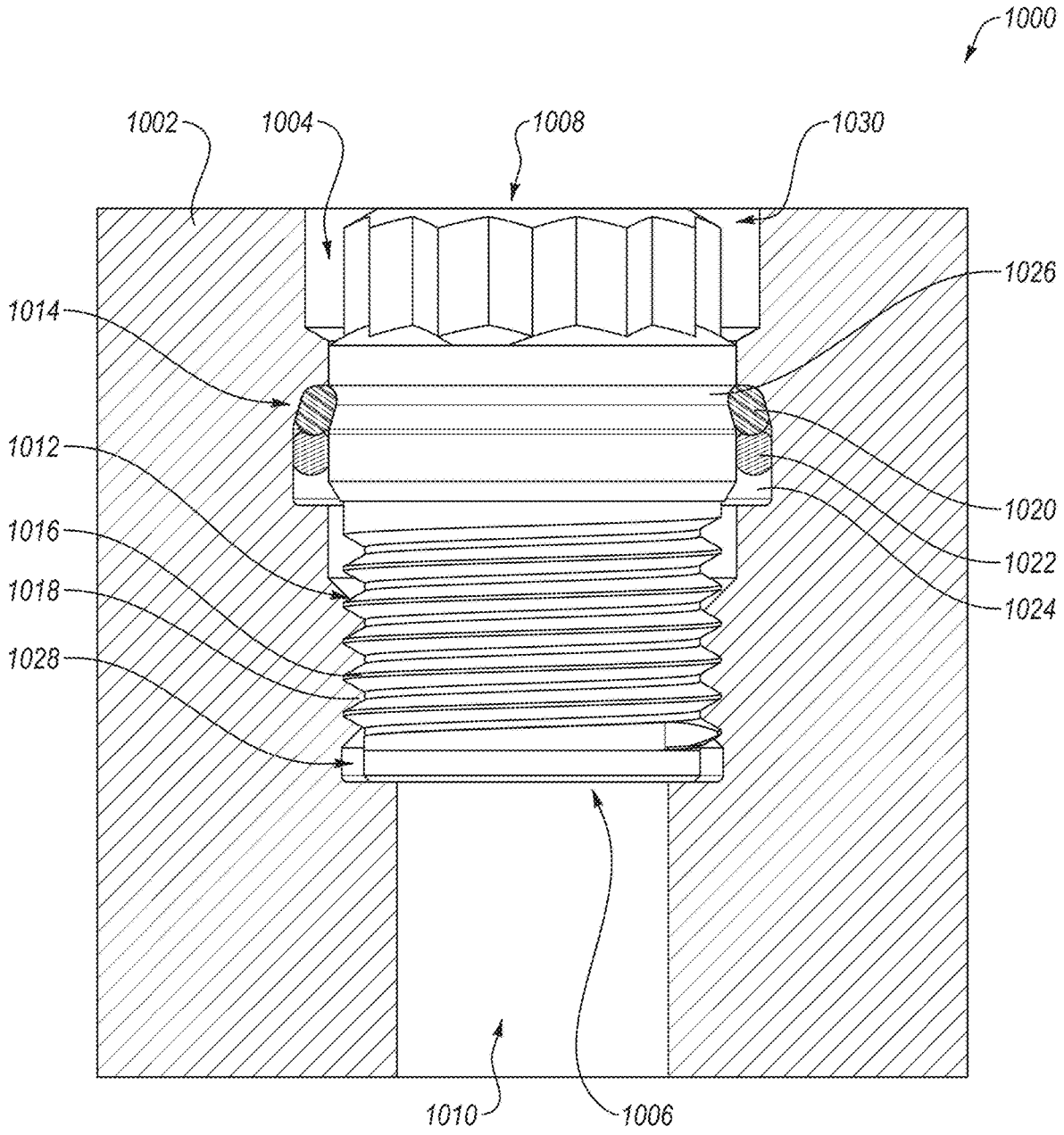
FIG. 10 illustrates an embodiment of a nozzle disposed in an earth-boring tool in accordance with embodiments of the disclosure.

FIG. 10 illustrates an embodiment of a nozzle 1000. The nozzle 1000 is installed in an earth-boring tool, such as earth-boring tool 100 (FIG. 1). The nozzle 1000 is disposed in an aperture 1004 defined by a tool body 1002. The nozzle 1000 includes an inlet 1006 and an outlet 1008 and is configured to receive a pressurized fluid from a fluid passage 1010 defined in the tool body 1002 and output the pressurized fluid through the outlet 1008. The nozzle 1000 is secured to the tool body 1002 through a primary securing interface 1012 and a secondary securing interface 1014.

In the embodiment illustrated in FIG. 10 the primary securing interface 1012 includes threads 1016 defined on the nozzle 108 that interface with complementary threads 1018 defined in the aperture 1004 of the tool body 1002. The secondary securing interface 1014 is created by interference between an annular seal 1022 and a seal cavity 1024 defined in the tool body 1002 and a securing recess 1026 defined in the nozzle 1000.

In the embodiment illustrated in FIG. 10 the primary securing interface 1012 is arranged proximate an inlet end 1028 of the nozzle 1000 and the secondary securing interface 1014 is arranged proximate an outlet end 1030 of the nozzle 1000. In other embodiments, the primary securing interface 1012 may be positioned proximate the outlet end 1030 and the secondary securing interface 1014 may be positioned proximate the inlet end 1028 similar to the embodiment illustrated in FIGS. 3-5.

In the embodiment illustrated in FIG. 10, the pressurized fluid may pass through the area of the threads 1016 and the complementary threads 1018 to reach the seal cavity 1024. The seal cavity 1024 and the securing recess 1026 define a similar cross-sectional shape to the shape of the seal cavity 324, 622 (FIGS. 3 and 6) and the seal recess 326, 624 (FIGS. 3 and 6) described above. For example, the seal cavity 1024 and the securing recess 1026 include parallel inclined surfaces configured to direct an annular securing ring 1020 into the securing recess 1026 when a pressure is applied by the pressurized fluid to an annular seal 1022 positioned below the annular securing ring 1020 in the seal cavity 1024. The pressurized fluid may cause the annular seal 1022 to move upward in the seal cavity 1024 applying an upward force to the annular securing ring 1020 moving the annular securing ring 1020 into the securing recess 1026. When the annular securing ring 1020 is directed into the securing recess 1026, a portion of the annular securing ring 1020 overlaps into the cross-sectional area of the nozzle 1000 creating an interference that serves to impede axial movement of the nozzle 1000 through the interference between the annular securing ring 1020 and the securing recess 1026.

The annular securing ring 1020 may be formed from a rigid material, such as a rigid polymer (e.g., polyether ether ketone (PEEK), polytetrafluoroethylene (PTFE), polycarbonate, polyvinyl chloride (PVC), acrylonitrile butadiene styrene (ABS), etc.), a metal material (e.g., carbon steel alloys, stainless steel alloys, aluminum alloys, copper alloys, etc.), or a shape memory alloy material (e.g. nickel titanium alloys, copper aluminum nickel alloys, iron manganese silicon alloys, etc.). The rigid material of the annular securing ring 1020 may be configured to spring back when fluid pressure is removed from the annular seal 1022. For example, the fluid pressure applied to the annular seal 1022 may cause the annular securing ring 1020 to move upward into the securing recess 1026 deforming the annular securing ring 1020 to move the upper portion of the annular securing ring 1020 into the securing recess 1026. When the fluid pressure is released, the deformed annular securing ring 1020 may spring back to the un-deformed shape through stored elastic energy in the material of the annular securing ring 1020 that act to return the annular securing ring 1020 to the un-deformed shape by applying a force induced by the stored elastic energy to the surfaces of the securing recess 1026 moving the annular securing ring 1020 downward out of the securing recess 1026.

The annular seal 1022 may be formed from a flexible material configured to deform under pressure to form a fluid seal. For example, the annular seal 1022 may be formed from rubber or flexible polymers (e.g., Nitrile, Neoprene, Ethylene Propylene (EPDM Rubber), Silicone, Fluorocarbon, etc.).

The annular seal 1022 is configured to compress against sealing surfaces of the seal cavity 1024 and the nozzle 1000 in an area beneath the annular securing ring 1020 to substantially prevent the pressurized fluid from passing axially beyond the annular seal 1022 to maintain the pressure of the pressurized fluid in the area axially below the nozzle 1000, which may maximize the volume and pressure of the pressurized fluid passing through a fluid passage 1010 of the nozzle 1000. The annular seal 1022 compressing against the sealing surfaces of the seal cavity 1024 and the nozzle 1000 may also substantially prevent pressurized fluids in the wellbore outside the earth-boring tool from passing between the nozzle 1000 and the tool body 1002 and contaminating the pressurized fluid being supplied by the fluid passage 1010 and/or damaging internal components of the associated earth-boring tool.

In some embodiments, the annular securing ring 1020 and the annular seal 1022 are formed as a single hybrid component having a securing portion configured to act as the annular securing ring 1020 and a sealing portion configured to act as the annular seal 1022. For example, the hybrid component may be formed from two different materials bonded together, such that the securing portion is formed from a rigid material and the sealing portion is formed from as flexible material. In some embodiments, the securing portion includes a rigid core embedded within a flexible outer structure and the flexible outer structure also forms the flexible sealing portion. In another example, the hybrid component may be formed entirely from a flexible material, where the securing portion has a complementary shape to the securing recess 1026 and the sealing portion is shaped and configured to compress and expand within the seal cavity 1024 to form the fluid seal upon moving the securing portion into the securing recess 1026.

Embodiments of the disclosure provide a secondary securing interface for nozzles secured to an earth-boring tool. Nozzles control and direct flow of pressurized fluids into a cutting area of the associated earth-boring tool, such as for removing debris and cooling cutting elements of the earth-boring tool. Nozzles secured through a single securing interface have a tendency to loosen or even fall out of the earth-boring tool when subjected to the vibrations, pressures, and temperature changes present in a well-bore during a drilling operation. The loss or repositioning of the nozzles may result in premature wear of the earth-boring tool and/or a loss of efficiency of the drilling operation. This may cause the earth-boring tool to be tripped out of the wellbore prematurely, which can result in significant monetary and time losses for a drilling operation.

The secondary securing interface of the disclosure utilizes fluid pressure that is already present in a drilling operation to activate a secondary securing interface configured to limit axial movement of the respective nozzles when the pressure is applied. This may substantially prevent nozzles from loosening or falling out during a drilling operation while the fluid pressure is applied. The nozzles may remain removable when the pressure is released, such that the nozzles may be moved, repaired, or replaced.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. An earth-boring tool comprising:

a nozzle comprising:

a nozzle body; and a nozzle seal cavity defined by an outer nozzle wall of the nozzle body, the outer nozzle wall defining a non-recessed surface, a seal surface, a full depth portion, and an inclined surface extending from the full depth portion to the non-recessed surface the inclined surface extending at an angle relative to the non-recessed surface; and a tool body defining an aperture configured to receive the nozzle, the tool body defining:

a threaded portion extending into the aperture; and an annular seal cavity extending from the aperture into the tool body, the annular seal cavity defined by an outer wall, the outer wall including a full width portion, a sealing surface configured to substantially align with the seal surface of the outer nozzle wall of the nozzle body, and an inclined surface extending between the full width portion and the sealing surface, the inclined surface extending at an angle relative to the full width portion of the outer wall, wherein the inclined surface of the outer wall of the tool body is substantially parallel to the inclined surface of the outer nozzle wall of the nozzle body.

2. The earth-boring tool of claim 1, wherein the nozzle comprises: complementary threads engaged with the threads defined by the tool body.

3. The earth-boring tool of claim 1, further comprising an annular seal positioned in the annular seal cavity, wherein the inclined surface of the outer wall of the annular seal cavity is configured to move the seal partially into the nozzle seal cavity of the nozzle under an applied fluid pressure.

4. The earth-boring tool of claim 3, wherein the nozzle seal cavity defines an area in an axial cross-sectional plane of the nozzle, the area configured to receive a portion of the annular seal and create an overlap of the annular seal with a radial cross-sectional area of the nozzle.

5. The earth-boring tool of claim 4, wherein the area defined by the nozzle seal cavity is configured to receive an overlap portion of the annular seal in a range from about 10% of a cross-sectional area of the annular seal to about 50% of the cross-sectional area of the annular seal in the axial cross-sectional plane.

6. The earth-boring tool of claim 1, wherein an exterior geometry of the nozzle defines a fluid pathway configured to direct a fluid flow to the annular seal cavity.

7. The earth-boring tool of claim 1, wherein the annular seal cavity is positioned proximate an inlet end of the aperture defined by the tool body.

8. The earth-boring tool of claim 1, wherein the annular seal cavity is positioned proximate an outlet end of the aperture defined by the tool body.

9. A nozzle for use in an earth-boring tool, the nozzle comprising:

a body;

a primary securing structure comprising threads extending radially from the body of the nozzle;

a secondary securing structure comprising a seal recess defined in the body of the nozzle and axially spaced from the primary securing structure; and a tapered structure extending between the secondary securing structure and an inlet end of the body of the nozzle.

10. The nozzle of claim 9, wherein the primary securing structure is positioned proximate an inlet end of the nozzle and the secondary securing structure is positioned proximate an outlet end of the nozzle.

11. The nozzle of claim 9, wherein the primary securing structure is positioned proximate an outlet end of the nozzle and the secondary securing structure is positioned proximate an inlet end of the nozzle.

12. The nozzle of claim 9, wherein the tapered structure comprises a tapered frustoconical structure.

13. The nozzle of claim 12, wherein the tapered frustoconical structure comprises at least one angled surface extending at an angle relative to an axis of the nozzle in a range from about 30° to about 60°.

14. A method of securing a nozzle in an earth-boring tool, the method comprising:

disposing an annular seal in a seal cavity defined around an aperture defined in a body of the earth-boring tool;

threading the nozzle into the aperture defined in the body of the earth-boring tool;

aligning a seal recess defined in the nozzle with the seal cavity; and applying a fluid pressure from an inlet side of the nozzle to the annular seal and causing the annular seal to move at least partially into the seal recess responsive to the fluid pressure, such that the annular seal contacts a sealing surface in each of the seal cavity and the seal recess.

15. The method of claim 14, wherein applying the fluid pressure further causes an overlap portion of the annular seal to move into the seal recess, the overlap portion in a range from about 10% of a cross-sectional area of the annular seal to about 50% of the cross-sectional area of the annular seal in an axial cross-sectional plane of the nozzle.

16. The method of claim 14, further comprising flowing a fluid through a fluid passage defined in the nozzle and applying the fluid pressure to the annular seal by diverting a portion of the fluid flowing through the fluid passage to the annular seal.

17. The method of claim 14, wherein disposing the annular seal partially into the seal recess through the fluid pressure comprises directing the annular seal radially inward by an inclined surface of an outer wall of the seal cavity.

18. The method of claim 14, further comprising securing the nozzle axially in the aperture by interference between the annular seal, a sealing surface of the seal cavity, and an inclined surface of the seal recess.

* * * * *